US005918094A

United States Patent [19]

Masuda et al.

[11] Patent Number: 5,918,094

[45] Date of Patent: Jun. 29, 1999

[54] TONER REPLENISHING DEVICE, FOR USE IN AN ELECTROPHOTOGRAPHIC APPARATUS FOR DEVELOPING TONER, WHICH STORES TONER AND SUPPLIES THE STORED TONER TO A DEVELOPMENT DEVICE

[75] Inventors: Junya Masuda, Kashihara; Hirokazu Yamauchi, Uji; Toshio Yamanaka, Yao, all of Japan

[73] Assignee: Sharp Kabushiki Kaisha, Osaka, Japan

[21] Appl. No.: 08/908,412

[22] Filed: Aug. 7, 1997

[30] Foreign Application Priority Data

Aug. 28, 1996 [JP] Japan ..... 8-227223

[51] Int. Cl.[6] ..... G03G 15/08

[52] U.S. Cl. ..... 399/258; 399/260; 399/262

[58] Field of Search ..... 399/258, 260, 399/262, 263, 27; 347/7; 222/DIG. 1

[56] References Cited

U.S. PATENT DOCUMENTS

| | | | |
|---|---|---|---|
| 4,133,459 | 1/1979 | Forward . | |
| 5,172,168 | 12/1992 | Satoh et al. | 399/262 |
| 5,329,340 | 7/1994 | Fukuchi et al. . | |
| 5,606,403 | 2/1997 | Kikuchi et al. | 399/27 |
| 5,621,507 | 4/1997 | Nishimura et al. | 399/262 |

FOREIGN PATENT DOCUMENTS

| | | |
|---|---|---|
| 0514874 | 11/1992 | European Pat. Off. . |
| 0516090 | 12/1992 | European Pat. Off. . |
| 2-148072 | 6/1990 | Japan . |
| 4-115272 | 4/1992 | Japan . |
| 4264574 | 9/1992 | Japan . |
| 535095 | 2/1993 | Japan . |
| 7-230208 | 4/1995 | Japan . |

*Primary Examiner*—Arthur T. Grimley
*Assistant Examiner*—Quana Grainger

[57] ABSTRACT

A toner replenishing device has a hopper for storing toner. The hopper has an L-shaped so as to have a large volume in a lateral direction, thereby ensuring that the hopper has the volume corresponding to several toner containers. The toner stored in a lower portion of the hopper is transported by toner transport devices to the vicinity of a toner supply opening provided on the tip of the hopper. The remaining amount of toner is detected by sensors that detect the amount of toner remaining in the toner replenishing device step-by-step. This results in a toner replenishing device having a large toner storage section (1) in which the aggregation of toner due to dead weight can be prevented and (2) in which the amount of toner remaining can be displayed step-by-step and the supply of toner can be carried out in advance before a shortage of toner occurs.

13 Claims, 16 Drawing Sheets

TONER REPLENISHING DEVICE, FOR USE IN AN ELECTROPHOTOGRAPHIC APPARATUS FOR DEVELOPING TONER, WHICH STORES TONER AND SUPPLIES THE STORED TONER TO A DEVELOPMENT DEVICE

FIELD OF THE INVENTION

The present invention relates to a toner replenishing device for supplying toner to a development device for use in an electrophotographic apparatus such as a copying machine, a printer, and other apparatuses, and more particularly to a toner replenishing device for use in an electrophotographic apparatus adopting a dry-type development system.

BACKGROUND OF THE INVENTION

A toner replenishing device for use in an electrophotographic apparatus such as a copying machine, a printer, and other apparatuses supplies toner stored in a vertical hopper to a development device. The toner stored in the hopper is supplied to the development device through a toner supply opening provided in the lower portion of the hopper.

In general, a remaining toner amount detecting sensor is provided inside the hopper. When the amount of toner in the hopper becomes less than a predetermined amount, the remaining toner amount detecting sensor detects the absence of toner, and a message ("REPLENISH TONER") indicating the shortage of toner is displayed on a display section provided on the electrophotographic apparatus.

However, a conventional toner replenishing device has a problem in that in the case of adopting a hopper having a large volume, toner aggregates at the bottom of the hopper due to the dead weight, thereby limiting the amount of toner that can be stored in the toner replenishing device to the amount which does not cause aggregation. Namely, toner can be stored in the toner replenishing device only in the amount of one toner container having a specified volume. For this reason, it is required to replenish the toner in a short cycle before a service person could replenish the toner in his or her regular visit, thus requiring the user to replenish the toner which may be annoying for the users.

Further, since a single remaining toner amount detecting sensor is provided inside the hopper, toner becomes empty shortly after the notice of toner shortage. This causes the following problem. When a large amount of copying, inefficient copying occurs because the copying machine stops while still preparing new toner due to the shortage thereof.

SUMMARY OF THE INVENTION

It is an object of the present invention to provide a toner replenishing device, having a large toner storage section, which displays the amount of remaining toner step-by-step so as to replenish toner in advance before the shortage of toner occurs.

In order to achieve the above-mentioned object, a toner replenishing device of the present invention for use in an electrophotographic apparatus for developing toner stores toner and supplies the toner stored to a development device. The toner replenishing device stores toner corresponding to an amount of several toner containers, each containing a predetermined amount of toner, and the toner replenishing device is provided with a toner replenishing opening for replenishing toner from outside, a toner supply opening for supplying toner to the development device, and a space provided extending in a direction from the toner replenishing opening to the toner supply opening, the direction being substantially perpendicular to the direction of gravity.

In the toner replenishing device having the above-mentioned arrangement, since the toner storage section is provided extending in a direction almost perpendicular to the direction of gravity, a toner layer does not deposit high in the direction of gravity even in the case of storing a large amount of toner, thereby preventing the aggregation of toner due to the dead weight, and permitting the storage of a large amount of toner which corresponds to the volume of several toner containers.

For a fuller understanding of the nature and advantages of the invention, reference should be made to the ensuing detailed description taken in conjunction with the accompanying drawings.

BRIEF DESCRIPTION OF THE DRAWINGS

FIG. 7(*b*) is an explanatory drawing showing a displaying example displayed on the display section of the operation control panel in the case where toner is present in the toner replenishing device in an amount less than the volume of one toner container; and FIG. 7(*c*) is an explanatory drawing showing a displaying example displayed on the display section of the operation control panel in the case where a vacant volume of the toner replenishing device exceeds the volume corresponding to two toner containers.

DESCRIPTION OF THE EMBODIMENTS

The following will explain one embodiment of the present invention. In the present embodiment, explanations will be given to the case where the toner replenishing device of the present invention is employed in a copying machine for example an electrophotographic apparatus.

Figure 2:
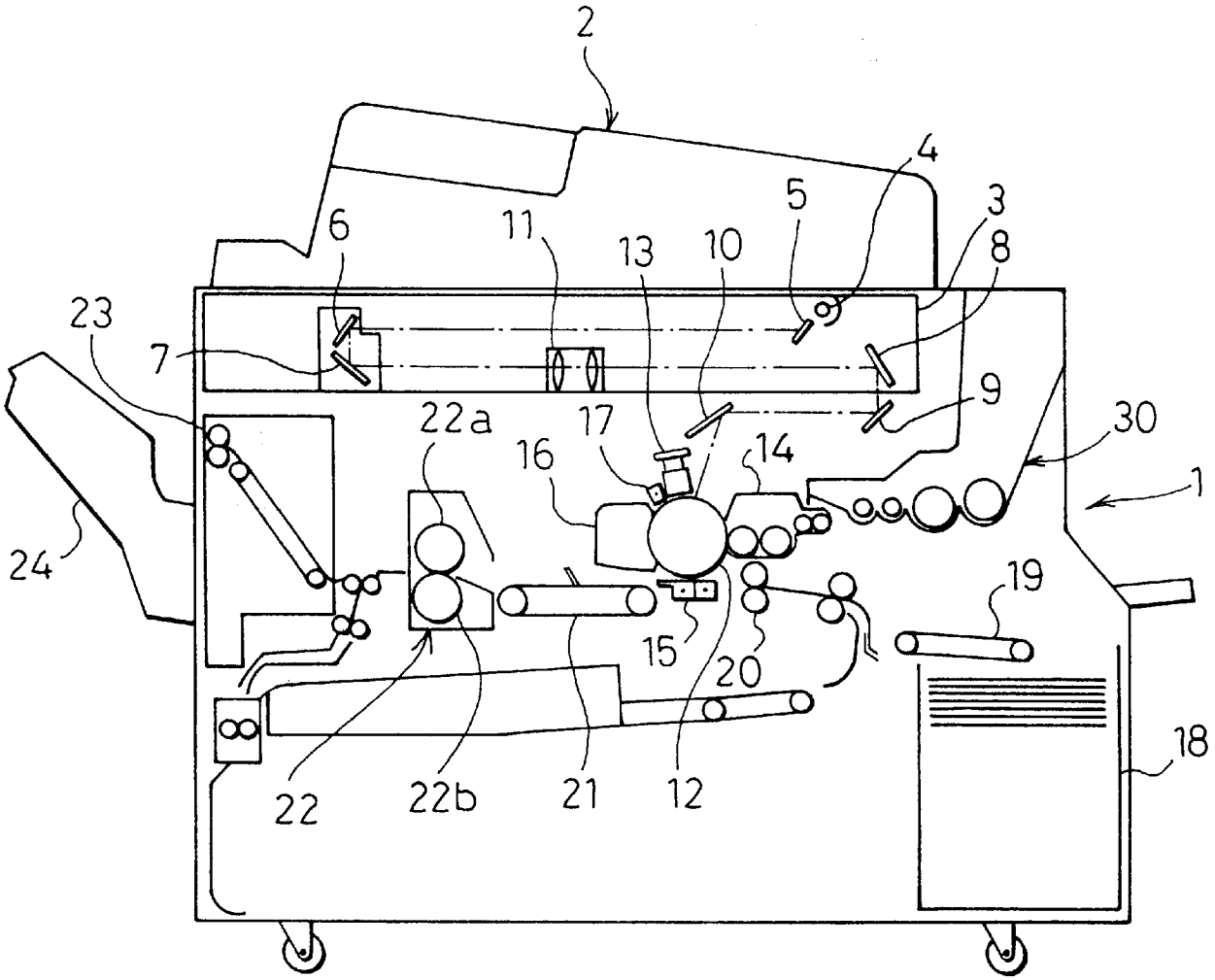
FIG. 2 is a drawing showing a schematic structure of a copying machine provided with the toner replenishing device.

As shown in FIG. 2, the copying machine of the present embodiment is composed of a copying machine main body 1 and an RDH (Recycle Document Handler) 2 as a processing section. The RDH 2 transports a document one after another a document exposure position, and transports the document back to the original position after the processing.

An optical system 3 for exposing a document image that forms an image is provided in an upper portion of the copying machine main body 1. The optical system 3 is provided with a copy lamp 4 such as a halogen lamp, a plurality of mirrors 5 through 10, and a zoom lens 11.

A photoreceptor 12 is rotatably provided below the optical system 3. The photoreceptor 12 is a recording medium formed in a drum shape having a photoconducting layer on its surface. Various types of devices for forming an image are provided around the photoreceptor 12. Such devices are a charger 13, a development device 14, a transfer unit 15, a cleaning device 16, a discharger 17, and other devices.

A toner replenishing device 30 for supplying toner to the development device 14 is provided on the side of the upper portion of the development device 14. Details of the toner replenishing device 30 will be explained later.

A sheet tray 18 is provided on the upstream side of the photoreceptor 12. The sheet tray 18 stores transfer sheets for use in transferring a copy image. A sheet feeding device 19 and register rollers 20 are provided between the development device 14 and the sheet tray 18. The sheet feeding device 19 sends transfer sheets stored in the sheet tray 18 to the development device 14. On the downstream side of the photoreceptor 12, a sheet adhering transport device 21, a fixing section 22, a sheet discharge section 23, and a finisher 24 are provided so as to process a transfer sheet which has been developed.

When the image forming is carried out by the copying machine having the described arrangement, first, the charger 13 uniformly charges the surface of the photoreceptor 12 to a predetermined potential. Then, in the optical system 3, the copy lamp 4 illuminates a document which has been set on a document platen (not shown) of the RDH 2, and the reflected light is projected on the surface of the photoreceptor 12 through the plurality of mirrors 5 to 10 and the zoom lens 11, thereby forming an electrostatic latent image corresponding to the image of the document on the photoreceptor 12.

Then, the electrostatic latent image is developed into a visible image by the development device 14. In the development device 14, the toner which has been supplied by the toner replenishing device 30 adheres to the electrostatic latent image formed on the photoreceptor 12 so as to form a toner image. Thereafter, the toner image formed on the photoreceptor 12 is transferred to a transfer sheet which has been sent by the sheet feeding device 19 from the sheet tray 18. Namely, the transfer sheet is sent through the register rollers 20 which send a transfer sheet in synchronization with the rotation of the photoreceptor 12, and the toner image is electrostatically transferred on the transfer sheet by the transfer unit 15. In the development device 14, toner is supplied by the toner replenishing device 30 when toner detecting sensors (not shown) detect the shortage of the toner.

Then, the transfer sheet is removed from the photoreceptor 12, and transported to the fixing section 22 through the sheet adhering transport device 21. The fixing section 22 is provided on a side where the fixing section 22 contacts the toner image for example, and the fixing section 22 is composed of a heat roller 22*a* and a pressure roller 22*b*. The heat roller 22*a* is heated to a constant temperature by a heating source. The pressure roller 22*b* is pressed against the heat roller 22*a* with an appropriate pressure. The transfer sheet is sandwiched between the heat roller 22*a* and the pressure roller 22*b* so as to heat and fix the toner image on the transfer sheet. The transfer sheet on which the toner image has been fixed and an image has been formed in the described manner is discharged to a finisher 24. The finisher 24 is provided such that its position moves up and down in accordance with the position of the sheet discharge section 23 provided in the copying machine main body 1.

Figure 1:
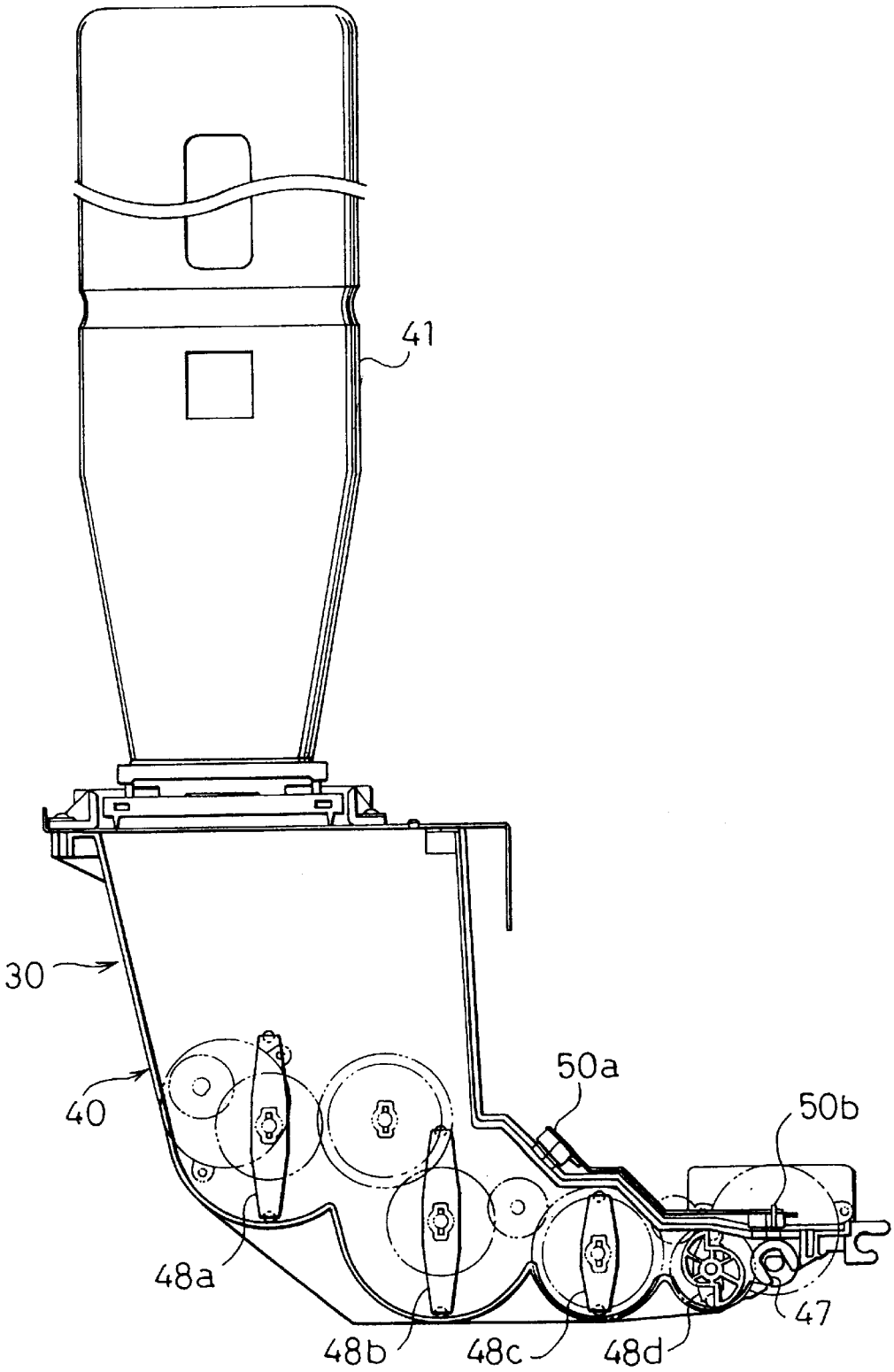
FIG. 1 is a drawing showing a schematic structure of a toner replenishing device with a toner container in accordance with one embodiment of the present invention.

Next, an explanation of the toner replenishing device 30 of the present invention will be given referring to FIG. 1, FIG. 3, FIG. 4, and FIG. 5. As shown in FIG. 1, the toner replenishing device 30 is provided with a hopper 40 as a storage section for storing toner. A toner container 41, storing a predetermined amount of toner, is attachable and detachably provided with respect to the upper surface of the hopper 40 such that the toner is supplied to the hopper 40 from the toner container 41. Note that, although FIG. 1 shows an arrangement wherein the toner container 41 is provided on the hopper 40, in the case of not supplying toner to the hopper 40, the toner container 41 is not attached to the hopper 40.

Figure 3:
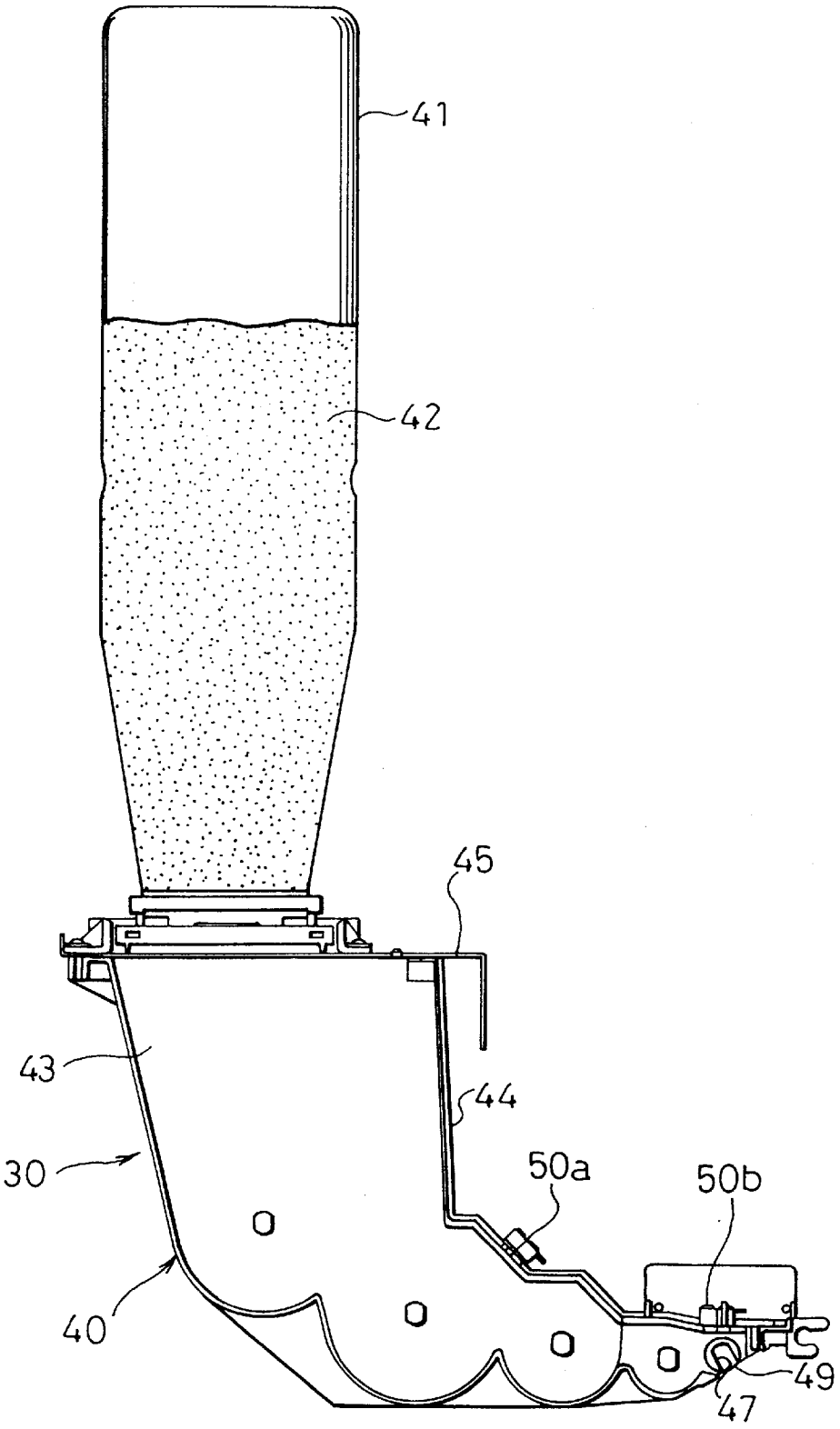
FIG. 3 is a drawing of a schematic structure of the toner replenishing device with the toner container, showing the shape of the toner replenishing device.
Figure 4:
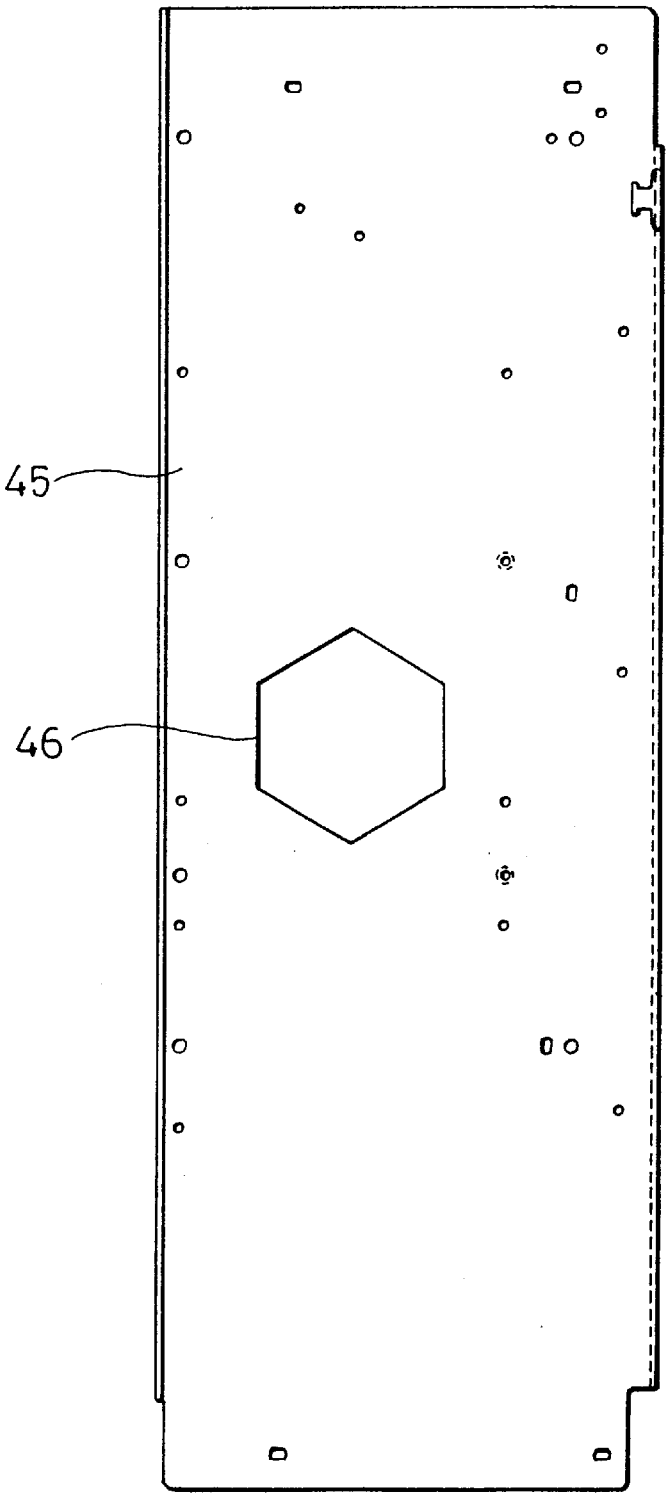
FIG. 4 is a schematic plan view showing a hopper board of the toner replenishing device.

As illustrated in FIG. 3, the hopper 40 of the toner replenishing device 30 is composed of a hopper main body 43, a hopper cover 44, and a hopper board 45. The hopper 40 has a large volume so as to store toner 42 contained in a plurality of toner containers 41, each toner container 41 having a specified volume. 12. The side of the hopper main body 43 has substantially an L-shape such that, in the lower portion of the hopper 40, the hopper main body 43 is provided, extending in a direction substantially perpendicular to the direction of gravity (referred to as lateral direction hereinafter). The hopper main body 43 is covered with a hopper cover 44 having substantially the same shape as the hopper main body 43, and the upper surface of the hopper main body 43 is capped with the hopper board 45. As shown in FIG. 4, a toner replenishing opening 46 is provided on the central portion of the hopper board 45. The toner replenishing opening 46 is provided in order to replenish the toner 42 from the toner container 41 to the hopper main body 43. Hence, the toner 42 stored in the toner container 41 is replenished into the hopper 40 through the toner replenishing opening 46 provided on the upper portion of the hopper 40.

Figure 5:
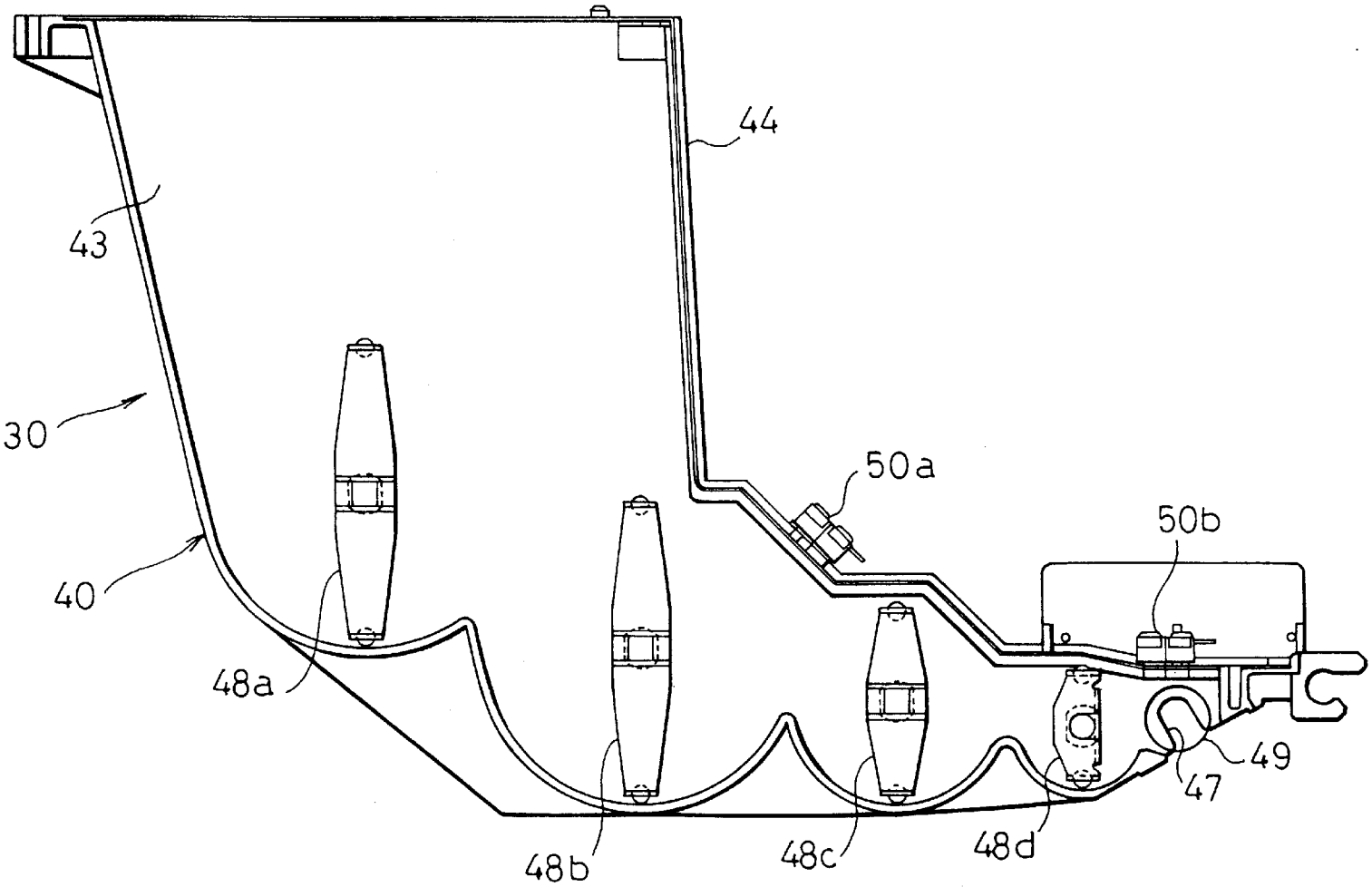
FIG. 5 is a drawing showing a schematic structure of how toner transport devices are provided in the toner replenishing device.

As shown in FIG. 5, the toner 42 stored in the toner replenishing device 30 is transported in a lateral direction to the vicinity of a toner supply opening 47 provided on the tip of the hopper 40. Note that, the toner 42 is transported by toner transport devices 48*a* through 48*d*. The toner 42 thus transported to the vicinity of the toner supply opening 47 is supplied to the development device 14 provided below the toner replenishing device 30 (see FIG. 2) by a toner supply roller 49 provided in a vicinity of the toner supply opening 47.

Namely, the toner replenishing device 30 is provided with the hopper 40 provided extending in the lateral direction. The toner replenishing device 30 having this arrangement transports the toner 42, which has been replenished through the toner replenishing opening 46, to the vicinity of the toner supply opening 47 with the aid of the toner transport devices 48*a* through 48*d*. The toner 42 thus transported to the vicinity of the toner supply opening 47 is supplied to the development device 14.

Note that, the operation of toner transport and the operation of toner supply are carried out every time the copying machine performs copying. The former is carried out by the toner transport devices 48*a* through 48*d* and the latter is carried out by the toner supply roller 49. Namely, the toner 42 in the development device 14 is consumed every time the copying machine performs copying; consequently, the shortage of toner in the development device 14 is detected, and the copying machine outputs a toner replenishing signal, thereby starting the toner transport operation and the toner supply operation which are respectively carried out by the toner transport devices 48*a* through 48*d* and the toner supply roller 49.

The hopper cover 44 is provided with remaining toner amount detecting sensors 50*a* and 50*b* which are provided in a vicinity of the central portion of the hopper 40 and in a vicinity of the toner supply opening 47, respectively. The remaining toner amount detecting sensors 50*a* and 50*b* (remaining toner amount detecting means) are provided for detecting the amount of toner remaining in the hopper 40. The remaining toner amount detecting sensors 50*a* and 50*b* are provided in a direction parallel to the toner transport direction so as to detect the upper surface of the toner being transported in the lateral direction. Note that, as the remaining toner amount detecting sensors 50*a* and 50*b* employed in the present embodiment, a widely adopted pressure sensor is adopted. The pressure sensor has a mechanism in which the oscillation of the sensor is suspended when the toner adheres to the surface of the sensor. That is to say, when the toner makes a contact to the surfaces of the remaining toner amount detecting sensors 50*a* and 50*b*, the sensors output signals, thereby detecting the presence or absence of the toner.

The remaining toner amount detecting sensor 50*a* is provided in such a position that (1) the presence of toner is detected when the amount of toner remaining in the hopper 40 exceeds the amount of toner corresponding to the volume of one toner container, and (2) the absence of toner is detected when the amount of toner remaining in the hopper 40 is less than the amount of toner corresponding to the volume of one toner container. The remaining toner amount detecting sensor 50*b* is provided in such a position that the absence of toner is detected when the toner in the hopper 40 is almost empty. With this arrangement, it is possible to detect the amount of toner remaining in the hopper 40, i.e., the corresponding number of toner containers.

The remaining toner amount detecting operation by the remaining toner amount detecting sensors 50*a* and 50*b* is carried out simultaneously with the toner transport operation when the copying machine main body 1 detects the shortage of toner and outputs the toner replenishing signal. The amount of toner remaining in the toner replenishing device 30 is detected based on the fact that a control section 31 (see FIG. 16) provided with a micro computer judges the result of the detection. The control section 31 is provided in the copying machine main body 1.

Figure 6:
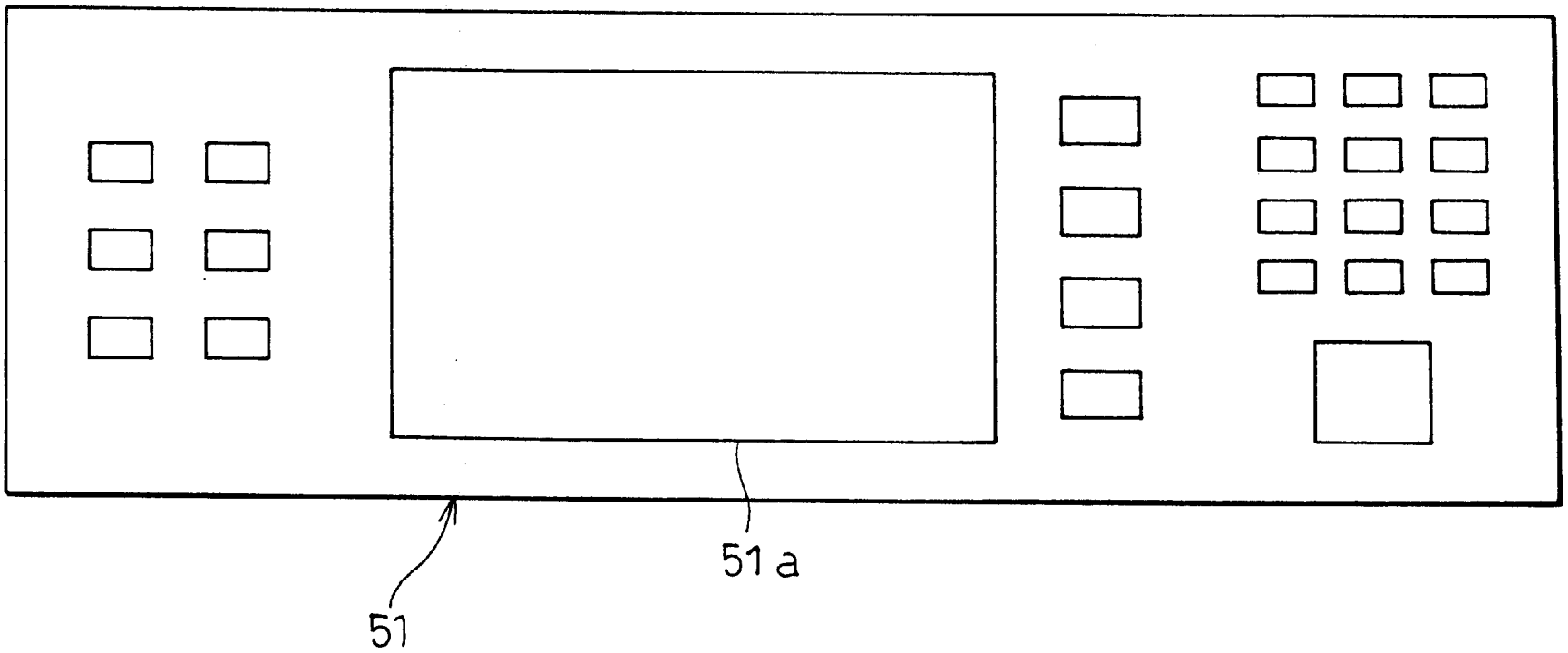
FIG. 6 is an explanatory drawing showing an operation control panel of the toner replenishing device.

As shown in FIG. 6, the amount of toner remaining in the toner replenishing device 30 as detected in the described manner is displayed on a display section 51*a* in the form of the corresponding number of toner containers. The display section 51*a* is provided on an operation panel 51 on which various kinds of operation switches such as a copy switch are provided. The operation panel 51 is provided on the copying machine main body 1.

Figure 7:
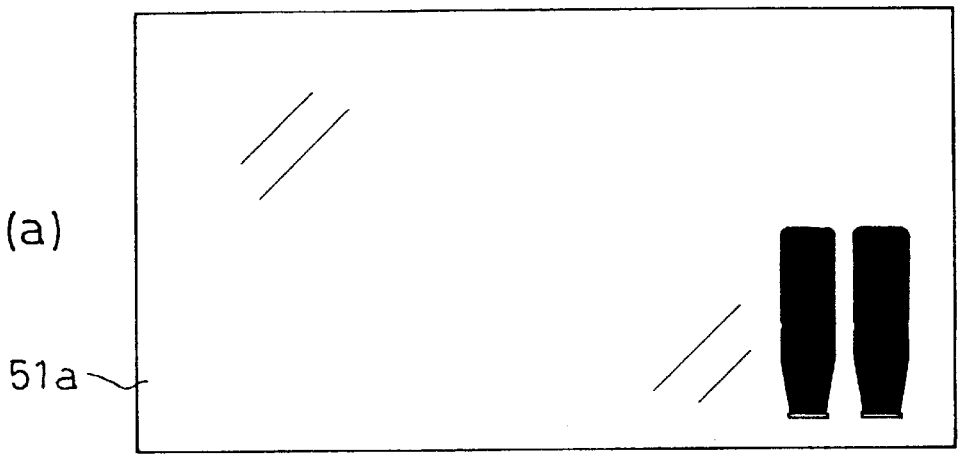
FIG. 7(*a*) is an explanatory drawing showing a displaying example displayed on a display section of the operation control panel in the case where toner is present in the toner replenishing device in an amount more than the volume of one toner container.
Figure 7:
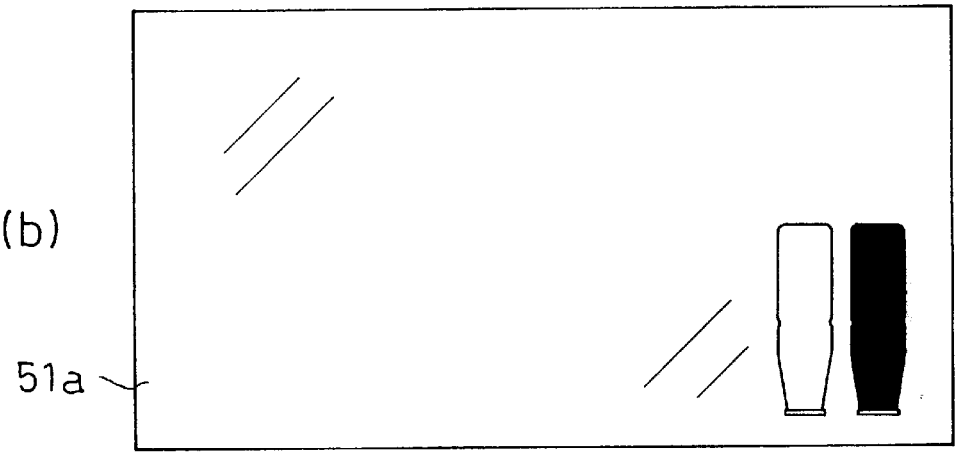
Figure 7:
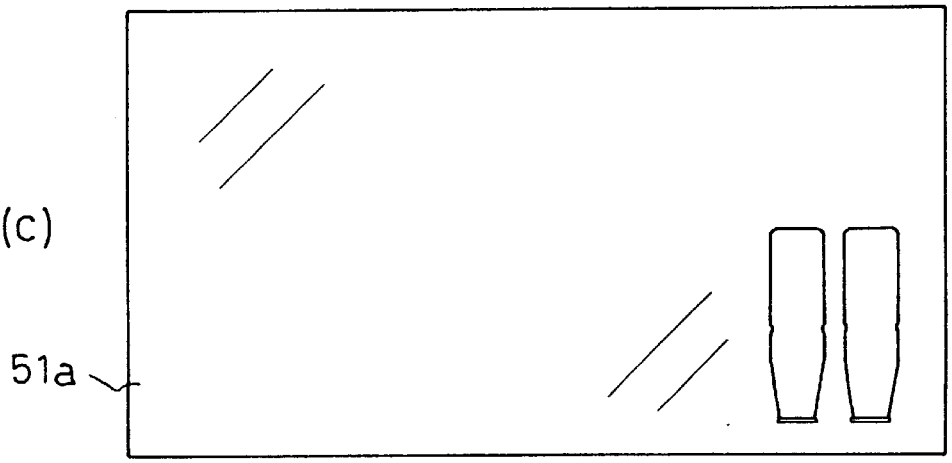

In the present embodiment, for example, the maximum volume of the toner replenishing device 30 is assumed to be the amount that is equal to two toner containers or more. The following will explain a case where an illustration of two toner containers is displayed on the display section 51*a* so as to indicate the amount of toner remaining in the toner replenishing device 30. In the case where the toner remaining in the toner replenishing device 30 exceeds the amount corresponding to the volume of one toner container, as shown in FIG. 7(*a*), the illustration of both toner containers are displayed in black on the display section 51*a*.

When the amount of toner remaining in the toner replenishing device 30 is reduced, due to the consumption derived from the copying operation, to an amount which is less than that corresponding to the volume of one toner container, the remaining toner amount detecting sensor 50*a* detects the absence of toner in the described manner. In this case, as shown in FIG. 7(*b*), the illustration of only one of the two toner containers is displayed in black on the display section 51*a*.

When the toner in the toner replenishing device 30 is further consumed and the vacant volume in the toner replenishing device 30 exceeds the volume corresponding to two toner containers, both of the remaining toner amount detecting sensors 50*a* and 50*b* detect the absence of toner. In this case, as shown in FIG. 7(*c*), the illustration of both containers are displayed in blanks. Here, the illustration of the blank containers on the display as shown in FIG. 7 does not indicate that the toner in the toner replenishing device 30 is completely empty.

The vacant volume in the toner replenishing device 30 can also be determined as follows: First, the duration in which the toner supply roller 49 of the toner replenishing device 30 supplies the toner to the development device 14 is measured since the absence of toner has been detected by the remaining toner amount detecting sensor 50*a*, and thereafter the amount of toner supplied to the development device 14 by the toner supply roller 49 is determined from the supply time thus determined. Then, (1) the vacant volume in the toner replenishing device 30 at the time the absence of toner is detected by the remaining toner amount detecting sensor 50*a* and (2) the amount of toner supplied are added so as to determine the total vacant volume in the toner replenishing device 30. Here, it is assumed that the amount of supplied toner per unit time to the development device 14 by the toner supply roller 49 is constant.

The amount of the supplied toner can also be determined by measuring the rotation number of the toner supply roller 49 provided that the amount of the supplied toner per one rotation of the toner supply roller 49 is constant.

When the above-described illustration is displayed on the display section, the toner may be supplied by the amount of one toner container when the illustration of FIG. 7(*b*) is displayed, or by the amount of two toner containers when the display of FIG. 7(*c*) is displayed.

If the toner adheres to the toner detecting surfaces of the remaining toner amount detecting sensors 50*a* and 50*b*, the remaining toner amount detecting sensors 50*a* and 50*b* are prevented from detecting the absence of toner. In a conventional arrangement where only one remaining toner amount detecting sensor is provided, a sensor oscillation plate can be provided for the remaining toner amount detecting sensor so as to remove the toner adhered to the toner detecting surface by the oscillation of the remaining toner amount detecting sensor.

However, in the case where a plurality of remaining toner amount detecting sensors are provided as in the present embodiment, it is not desirable to provide the sensor oscillation plate for each remaining toner amount detecting sensor because of the possibility that the required simultaneous detection by the remaining toner amount detecting sensors cannot be carried out as the timing of oscillation is delayed with respect to one another. Also, the cost increases if the sensor oscillation plate and its driving section are provided for each remaining toner amount detecting sensor.

Figure 8:
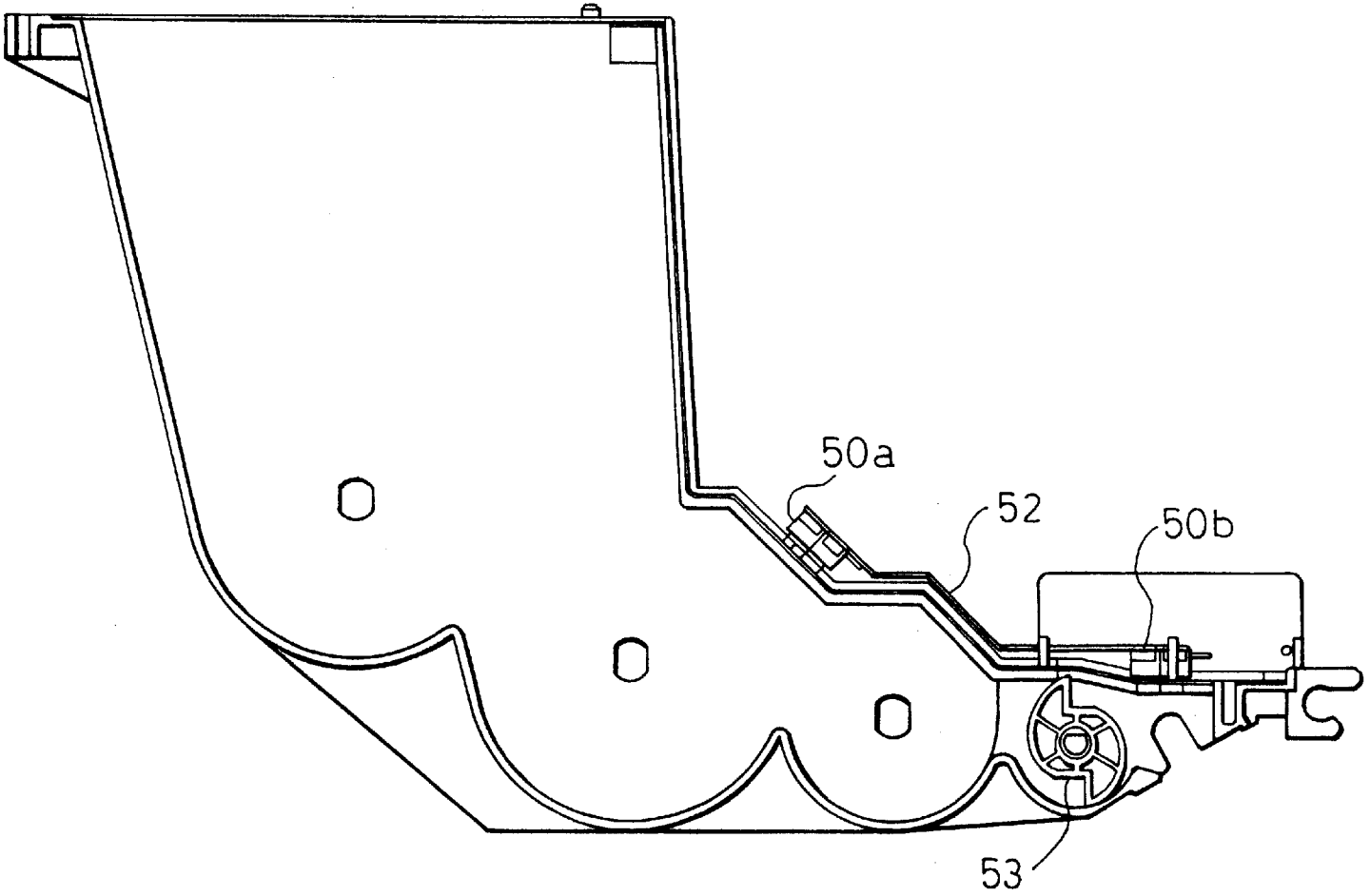
FIG. 8 is a drawing showing a toner adhesion preventing mechanism of a remaining toner amount detecting sensor, provided in the toner replenishing device of FIG. 1, for preventing the adhesion of the toner.
Figure 9:
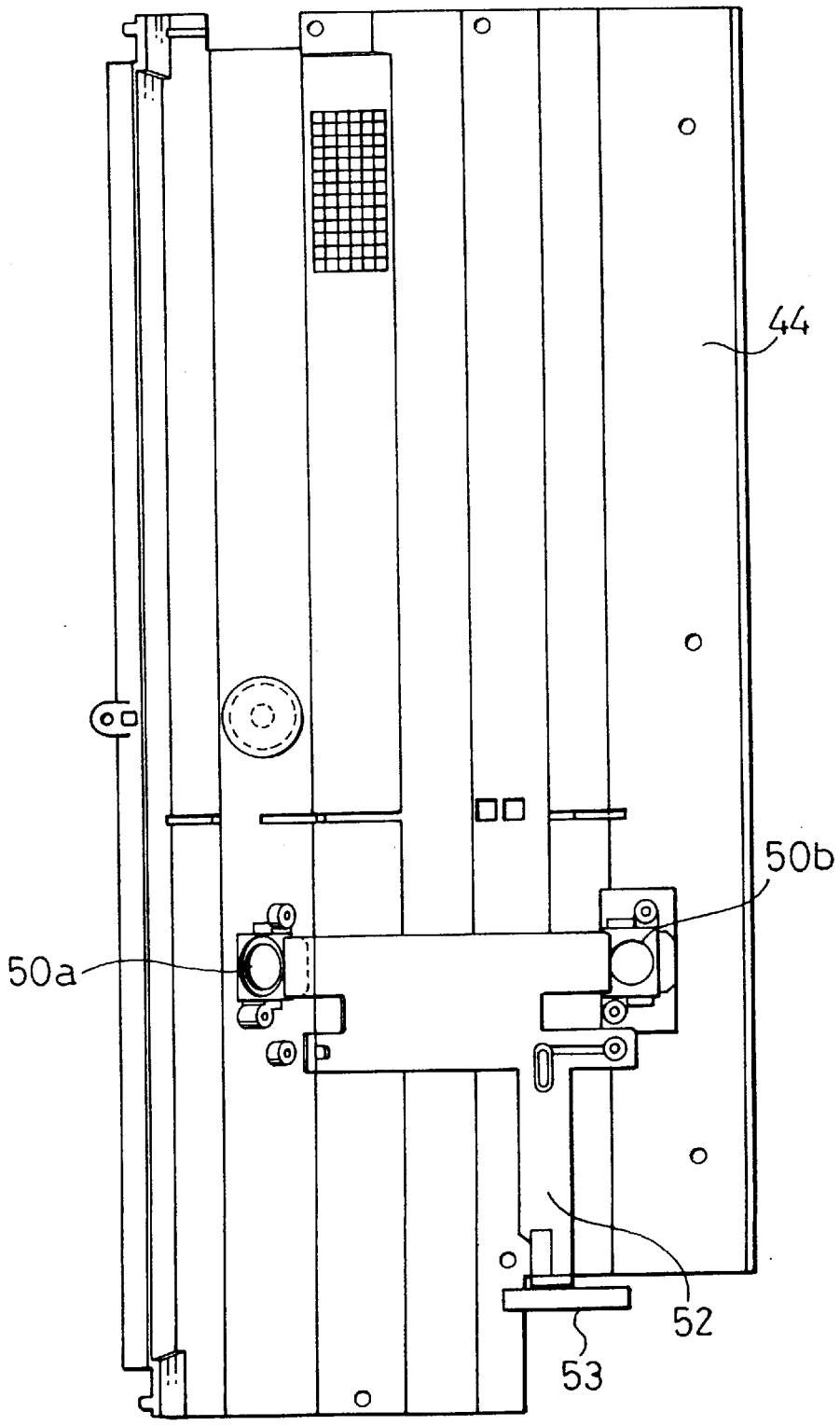
FIG. 9 is a schematic plan view showing the toner adhesion preventing mechanism of the toner replenishing device.

As a countermeasure, in the present embodiment, as shown in FIG. 8 and FIG. 9, a toner adhesion prevention mechanism is provided in which a sensor oscillation plate 52 is provided on a surface of the hopper cover 44 where the remaining toner amount detecting sensors 50*a* and 50*b* are provided. The sensor oscillation plate 52 oscillates in response to the rotation of a cam member 53 provided on the central shaft on which the toner transport device 48*d* is provided. The oscillation of the sensor oscillation plate 52 is transmitted to the remaining toner amount detecting sensors 50*a* and 50*b*, thereby preventing the adhesion of toner to the remaining toner amount detecting sensors 50*a* and 50*b*. Here, the cam member 53 rotates in synchronization with the toner replenishing operation.

Figure 10:
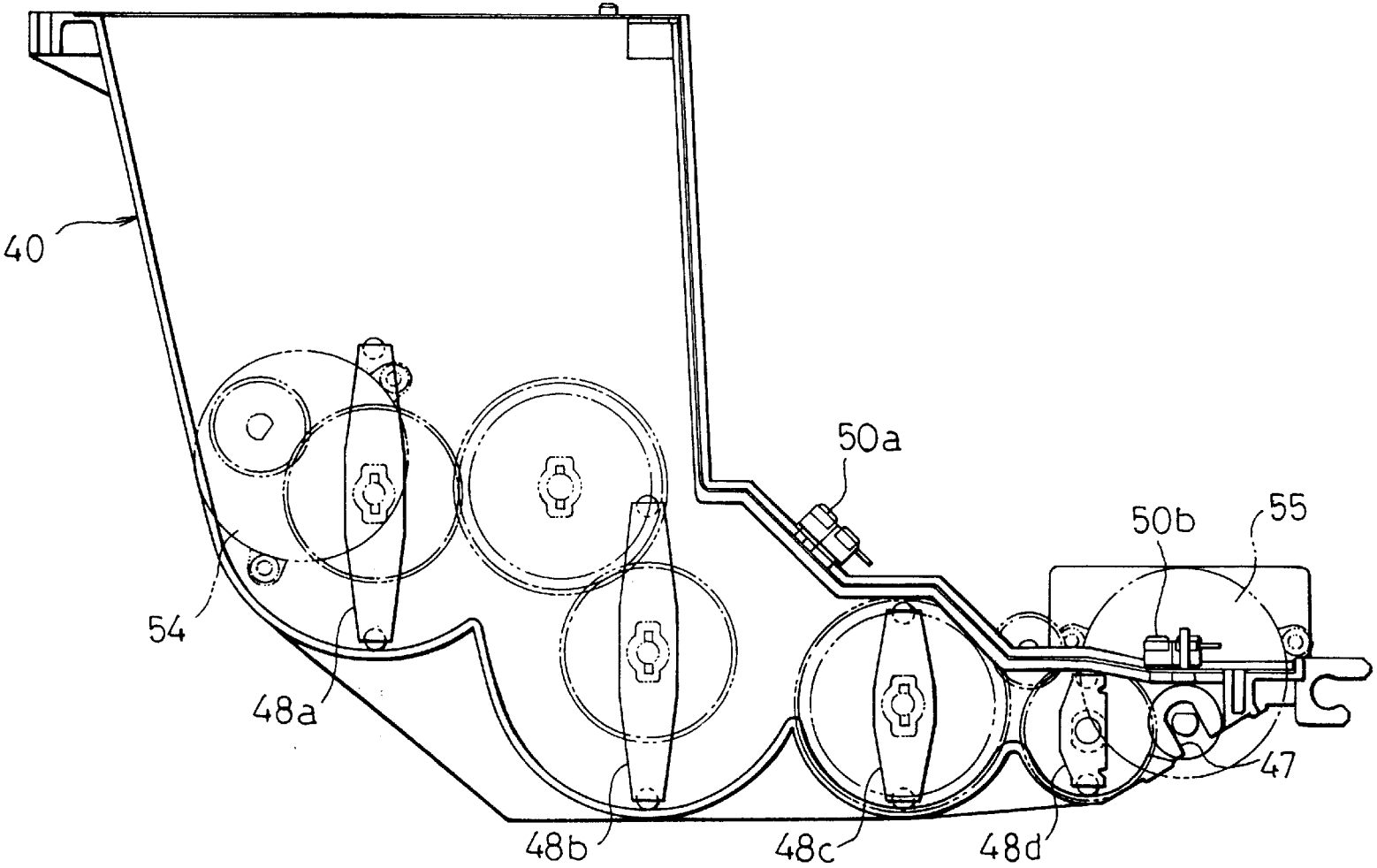
FIG. 10 is a drawing showing a schematic structure of toner transport means of the toner replenishing device.

As shown in FIG. 10, toner transport means of the present embodiment is composed of the toner transport devices 48*a* through 48*d*. Each of the toner transport devices 48*a* through 48*d* is composed of (1) a gear section for transmitting the driving power outside the hopper 40 and (2) a blade section for transporting the toner inside the hopper 40. A transport section provided with the toner transport devices 48*a* and 48*b* (referred to as first transport devices 48*a* and 48*b* hereinafter) is driven by a motor 54 as first driving means. The first transport devices 48*a* and 48*b* transport the toner in a vicinity of the toner replenishing opening 46 (see FIG. 4) to the vicinity of the lower central portion of the hopper 40. A transport section provided with the toner transport devices 48*c* and 48*d* (referred to as second transport devices 48*c* and 48*d* hereinafter) is driven by a motor 55 as second driving means. The second transport devices 48*c* and 48*d* transport the toner in the vicinity of the lower central portion of the hopper 40 to the vicinity of the toner supply opening 47.

Figure 16:
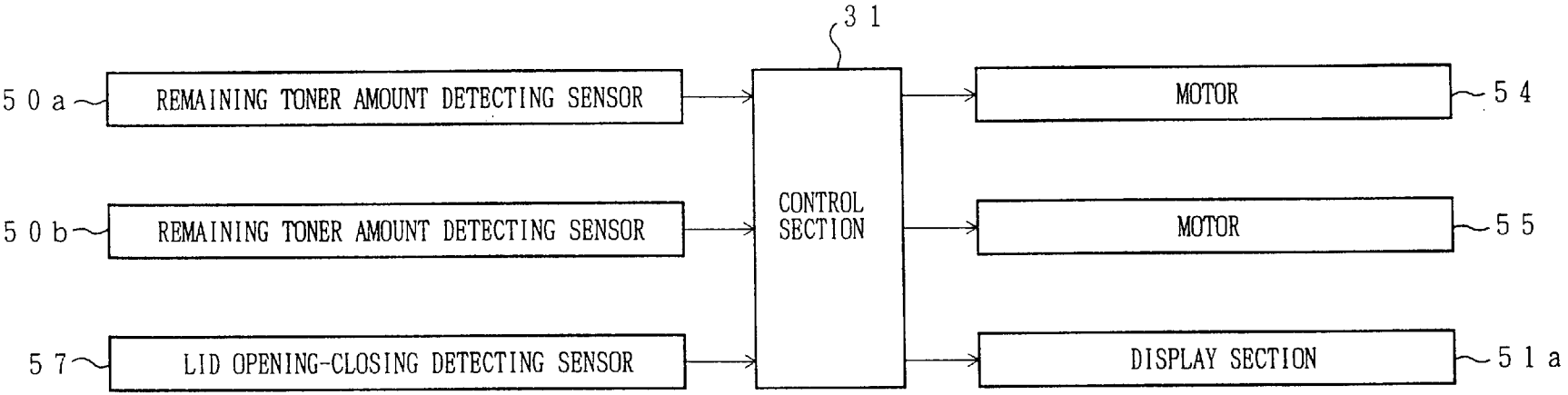
FIG. 16 a block diagram showing a structure of the copying machine of FIG. 2.

(1) The first transport devices 48*a* and 48*b* and (2) the second transport devices 48*c* and 48*d* are driven separately at predetermined positions such that the amount of toner transported respectively by (1) the first transport devices 48*a* and 48*b* and (2) the second transport devices 48*c* and 48*d* are an integral multiple of the volume of a toner container. Also, (1) the first transport devices 48*a* and 48*b* and (2) the second transport devices 48*c* and 48*d* are able to adjust the amount of toner transported per unit time according to the results of detection by the remaining toner amount detecting sensors 50*a* and 50*b*. Namely, as shown in FIG. 16, the results of detection by the remaining toner amount detecting sensors 50*a* and 50*b* are sent to the control section 31 as control means. The control section 31 controls the driving of the motors 54 and 55 according to the results of detection.

This arrangement ensures transport of the toner in the toner replenishing device 30 without generating a cavity in the toner or aggregation of the toner. Note that, (1) the first transport devices 48*a* and 48*b* and (2) the second transport devices 48*c* and 48*d* correspond respectively to first transport means and second transport means. Also, the remaining toner amount detecting sensor 50*a* and the remaining toner amount detecting sensor 50*b* correspond respectively to first remaining toner amount detecting sensor and second remaining toner amount detecting sensor.

For example, during copying operation of the copying machine main body 1, in the case where the remaining toner amount detecting sensor 50*b* and the remaining toner amount detecting sensor 50*a* respectively detect the absence and the presence of toner, the copying machine main body 1 receives the detection information, and controls the driving power of the motor 54 and the motor 55 such that the amount of toner transported by the first transport devices 48*a* and 48*b* is larger than that transported by the second transport devices 48*c* and 48*d*. Here, the remaining toner amount detecting sensor 50*b* and the remaining toner amount detecting sensor 50*a* are provided respectively around (1) the second transport devices 48*c* and 48*d* and (2) the first transport devices 48*a* and 48*b*.

Figure 11:
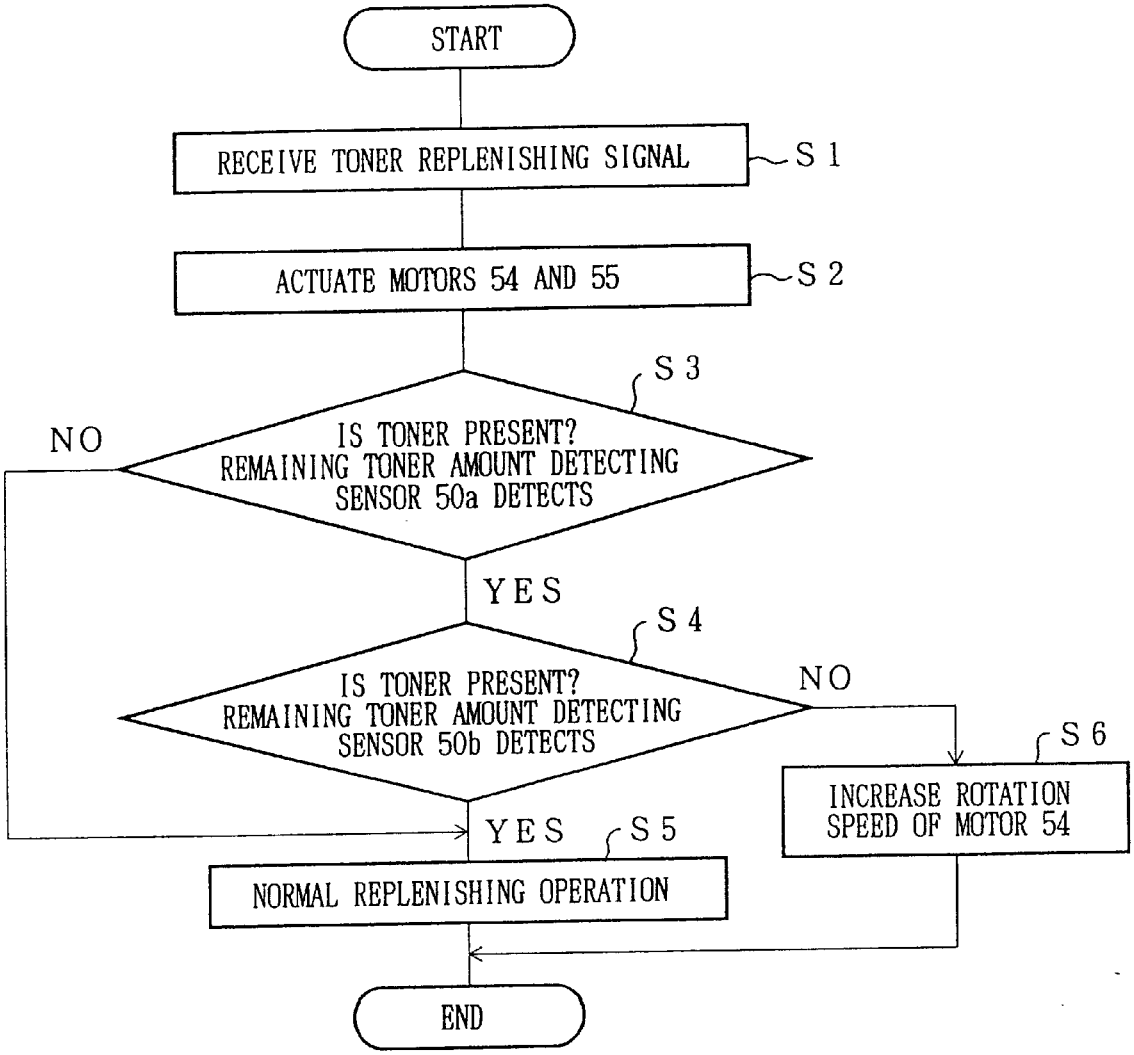
FIG. 11 is a flowchart showing the operation of the toner transport means during the operation of the copying machine of FIG. 2.

The following describes the above-mentioned operation of toner supply referring to the flowchart shown in FIG. 11. First, in the development device 14, when the shortage of toner is detected, a toner replenish signal is outputted from the copying machine main body 1, and the toner replenish signal is received by the toner replenishing device 30 (S1). The toner replenish signal thus received actuates the motors 54 and 55 (S2), and simultaneously, the remaining toner amount detecting sensors 50*a* and 50*b* carry out the detecting operation (S3, S4).

Namely, in S3, it is judged if the remaining toner amount detecting sensor 50*a* provided on the side of the upper portion of the hopper 40 detects the presence of toner. If it is judged in S3 that the remaining toner amount detecting sensor 50*a* detects the presence of toner, the sequence goes to S4, whereas the sequence goes to S5 if the absence of toner is detected in S3. In S4, it is judged if the remaining toner amount detecting sensor 50*b* provided in the vicinity of the toner supply opening 47 detects the presence of toner. If it is judged in S4 that the remaining toner amount detecting sensor 50*b* detects the presence of toner, the sequence goes to S5, whereas the sequence goes to S6 if the absence of toner is detected in S4.

In S5, a normal toner replenishing operation is carried out in which the amount of toner transported by (1) the first transport devices 48*a* and 48*b* and (2) the second transport devices 48*c* and 48*d* are equal. In S6, on the other hand, the rotation speed of the motor 54 is increased so that the amount of toner transported by the first transport devices 48*a* and 48*b* are larger than that transported by the second transport devices 48*c* and 48*d*. Note that, if the result of detection by the remaining toner amount detecting sensors 50*a* and 50*b* changes during a copying operation, the transport operation changes according to the new result of detection.

Figure 12:
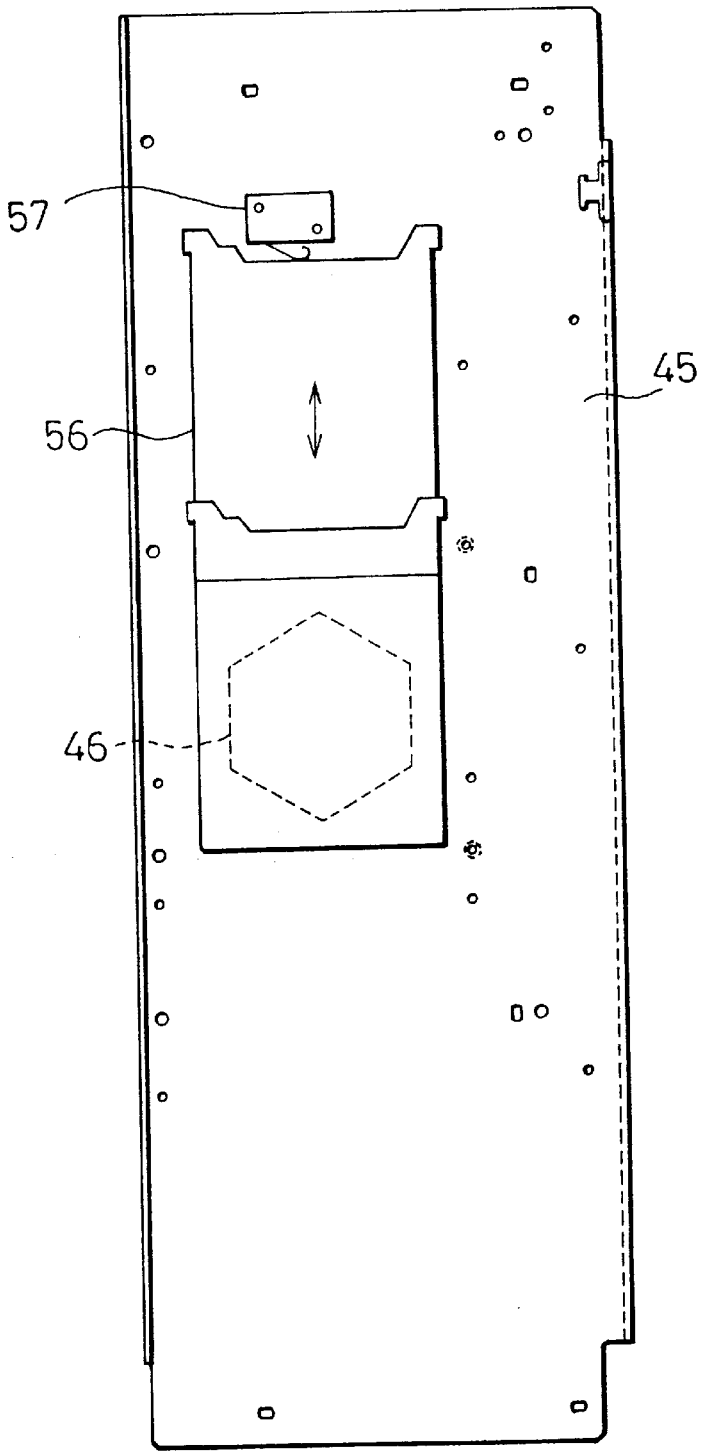
FIG. 12 is a schematic plan view showing a structure wherein a hopper board of FIG. 4 is provided with a lid member and a lid opening-closing detecting sensor.

The detecting operation by the remaining toner amount detecting sensors 50*a* and 50*b* continues even after toner has been supplied into the toner replenishing device 30. For example, as shown in FIG. 12, with respect to the toner replenishing opening 46 which is provided on the upper surface of the hopper board 45, a lid member 56 is slidably provided so that the toner replenishing opening 46 is opened and closed in accordance with the sliding. A lid opening-closing detecting sensor 57 detects the opening and closing of the lid member 56. Namely, the lid opening-closing detecting sensor 57 detects the closure of the lid member 56 after toner has been supplied into the toner replenishing device 30. This starts a post-toner-replenishing detecting operation by the remaining toner amount detecting sensors 50*a* and 50*b*.

For example, after replenishing the toner into the toner replenishing device 30, if the second transport devices 48*c* and 48*d* continue to operate despite the fact that the presence of toner is detected by the remaining toner amount detecting sensor 50*b* provided in a vicinity of the second transport devices 48*a* and 48*b*, it is likely that the toner in a vicinity of the toner supply opening 47 aggregate as the toner is forcibly pushed by the second transport devices 48*c* and 48*d*. Toner aggregated in this manner may obstruct the transport of toner and may cause a serious defect in an image in which a black spot is created.

Therefore, in the case where the remaining toner amount detecting sensor 50*b* detects the presence of toner, the motor 55 is stopped so as to stop the operation of the second transport devices 48*c* and 48*d*.

Figure 13:
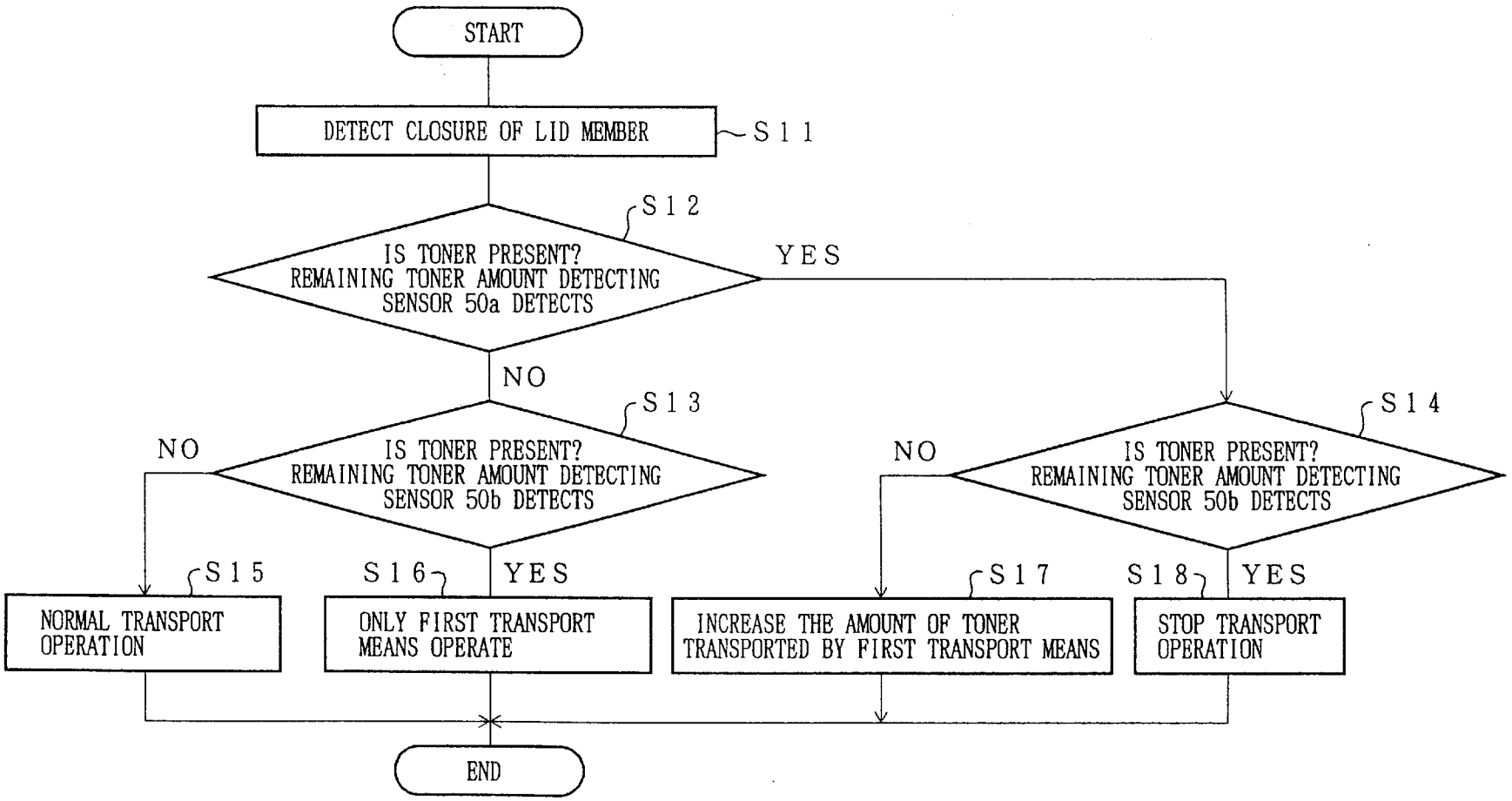
FIG. 13 is a flowchart showing the operation of the toner transport means when toner is supplied.

The following will describe the above-mentioned operation referring to the flowchart shown in FIG. 13. First, when the lid member 56 of the toner replenishing opening 46 is closed after replenishing the toner, the lid opening-closing detecting sensor 57 detects the closure of the lid member 56 (S11). When the closure of the lid member 56 is detected by the lid opening-closing detecting sensor 57, the remaining toner amount detecting sensors 50*a* and 50*b* start the detecting operation (S12 through S14).

Namely, in S12, it is judged if the remaining toner amount detecting sensor 50*a* provided on the side of the upper portion of the hopper 40 detects the presence of toner. If it is judged in S12 that the remaining toner amount detecting sensor 50*a* detects the absence of toner, the sequence goes to S13, whereas the sequence goes to S14 if the presence of toner is detected in S12. In S13 and S14, it is judged if the remaining toner amount detecting sensor 50*b* in the vicinity of the toner supply opening 47 detects the presence of toner.

In the case where both of the remaining toner amount detecting sensors 50*a* and 50*b* detect the absence of toner, a normal toner transport operation is carried out (S15).

In the case where the absence of toner is detected by the remaining toner amount detecting sensor 50*a*, and the presence of toner is detected by the remaining toner amount detecting sensor 50*b*, only the first transport devices 48*a* and 48*b* are operated and the operation of the second transport devices 48*c* and 48*d* are stopped (S16).

In the case where the presence of toner is detected by the remaining toner amount detecting sensor 50*a*, and the absence of toner is detected by the remaining toner amount detecting sensor 50*b*, both (1) the first transport devices 48*a* and 48*b* and (2) the second transport devices 48*c* and 48*d* are operated such that the amount of toner transported by the first transport devices 48*a* and 48*b* is larger than that of the second transport devices 48*c* and 48*d* (S17).

In the case where both of the remaining toner amount detecting sensors 50*a* and 50*b* detect the presence of toner, the operation of both (1) the first transport devices 48*a* and 48*b* and (2) the second transport devices 48*c* and 48*d* are stopped (S18). Note that, if the result of detection by the remaining toner amount detecting sensors 50*a* and 50*b* changes during a copying operation, the transport operation changes according to the new result of detection.

Figure 14:
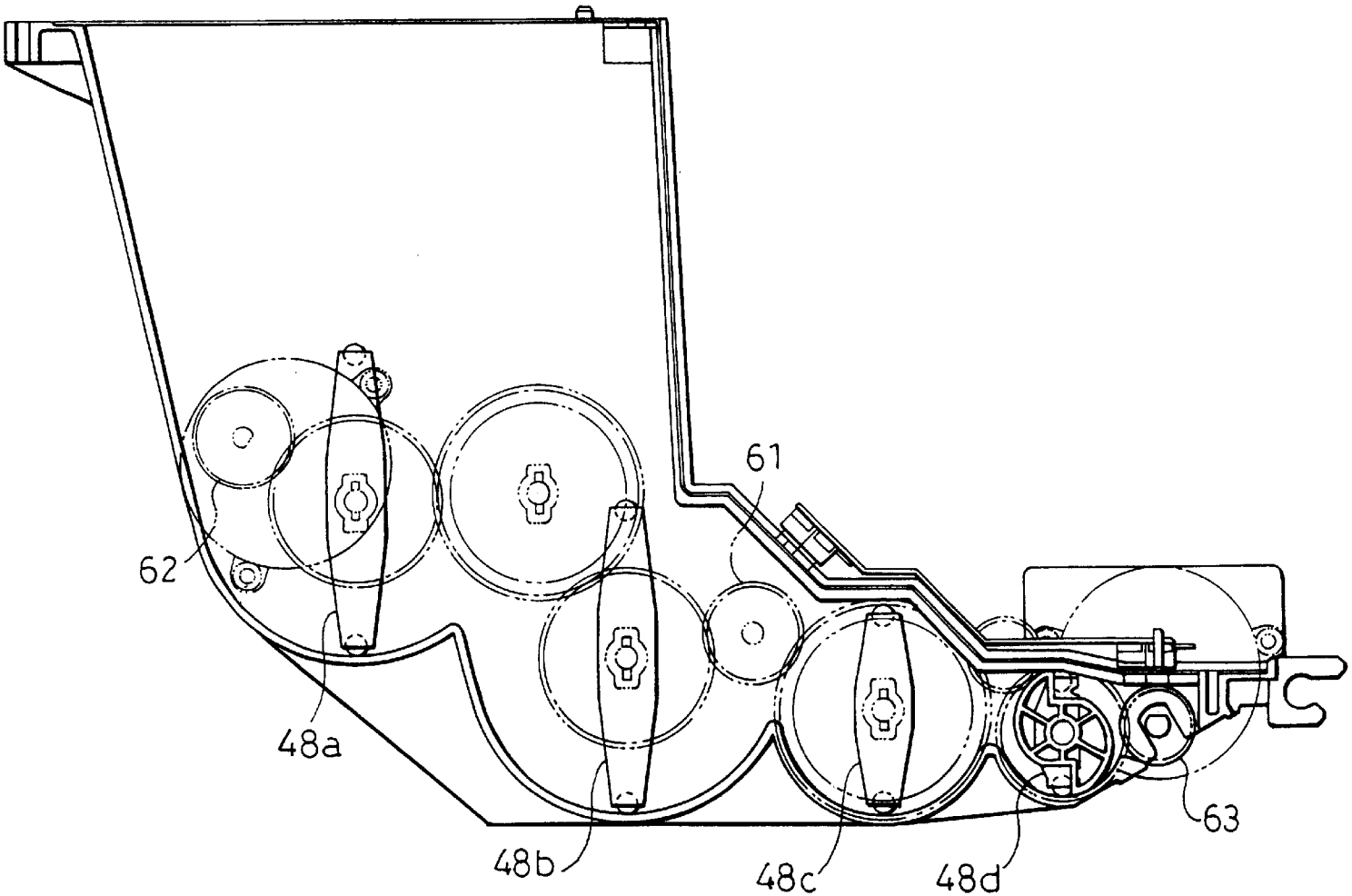
FIG. 14 is a drawing showing a schematic structure of how the toner transport devices are linked in the toner replenishing device of FIG. 1.

As described, in the toner replenishing device 30 of the present embodiment, (1) the first transport devices 48*a* and 48*b* and (2) the second transport devices 48*c* and 48*d* are driven respectively by the motor 54 and the motor 55. However, in the case one of the motors 54 and 55 fails to operate due to some problems, toner cannot be appropriately transported. As a countermeasure, in order to permit the driving of all the toner transport devices 48*a* through 48*d* with a single motor even in the case the other motor fails to operate, as shown in FIG. 14, (1) the first transport devices 48*a* and 48*b* and (2) the second transport devices 48*c* and 48*d* are arranged so as to be linked by a driving linkage member 61. The driving linkage member 61 is not meshed with any gears under a normal state. However, in the case one of the motors fails, the driving linkage member 61 is brought into mesh so as to link (1) the first transport devices 48*a* and 48*b* and (2) the second transport devices 48*c* and 48*d*.

As described above, (1) the first transport devices 48*a* and 48*b* and (2) the second transport devices 48*c* and 48*d* are linked by the driving linkage member 61 when one of the motors fails to operate. However, the driving linkage member 61 also transmits the driving power to the failed motor, thereby preventing the supply of driving power to the toner transport devices as the failed motor adds load.

Figure 15:
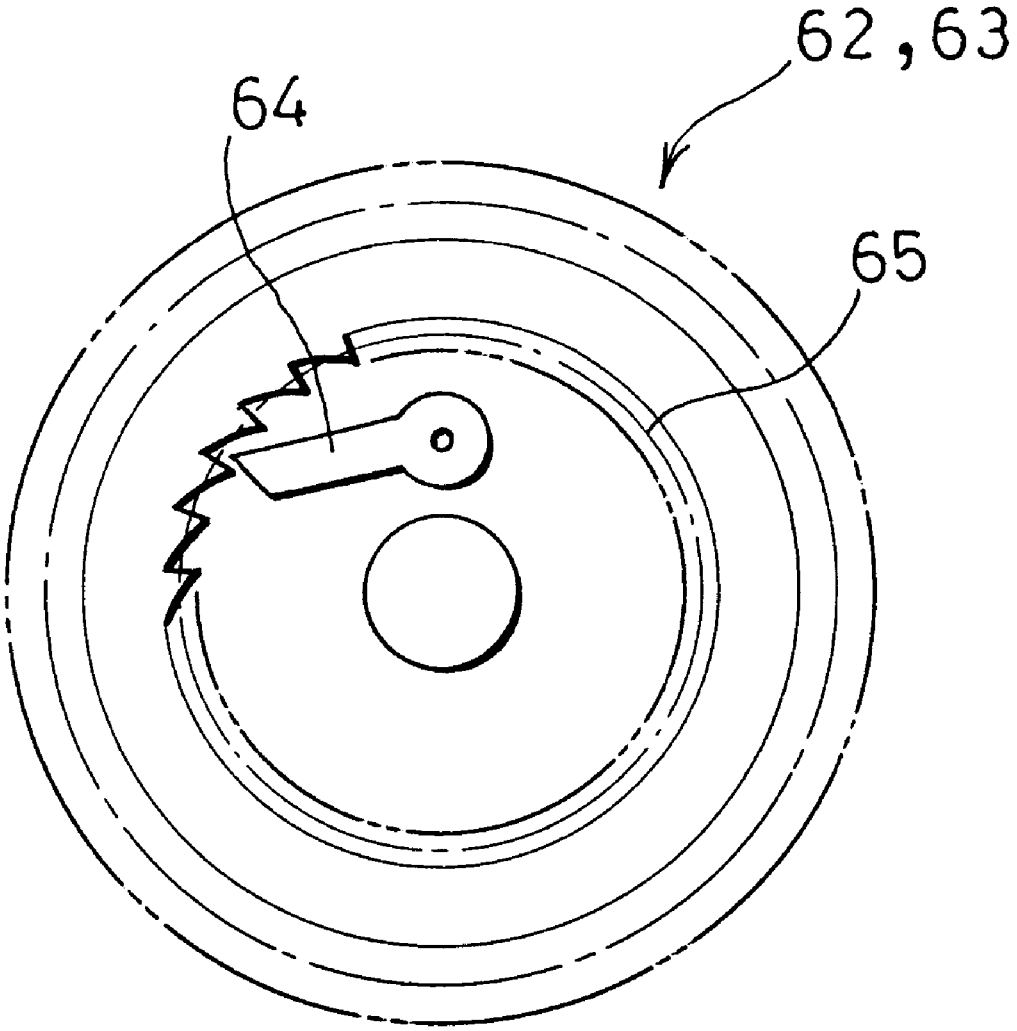
FIG. 15 is a drawing showing a schematic structure of a driving transmission member employed in the toner replenishing device.

As a countermeasure, driving transmission members 62 and 63 are provided. The driving transmission members 62 and 63 allow the driving power of the motor to transmit only in one direction. Namely, as shown in FIG. 15, if the driving transmission members 62 and 63 are composed of a ratchet 64 and a ratchet wheel 65, when transmitting the driving power to the toner transport devices, the ratchet 64 is caught by the teeth of the ratchet wheel 65 so that the driving power is transmitted. However, in the opposite direction, the rotation of the toner transport devices is not transmitted to the motor.

Note that, it is possible to drive all the plurality of driving transport devices by a single motor and a plurality of gears. However, in this case, in order to control the amount of toner transported, i.e. changing the amount of toner transported with respect to each of the plurality of toner transport devices, a large number of gears and clutches are required, thereby making the device large.

As described, as shown in FIG. 1, in order to realize a toner replenishing device 30 having a large volume that can store toner corresponding to the volume of several toner containers 41, the toner replenishing device 30 of the present embodiment has a large volume with respect to the lateral direction in which the toner is transported to the vicinity of the toner supply opening 47 by the toner transport devices 48*a* through 48*d*. Further, a plurality of remaining toner amount detecting sensors 50*a* and 50*b* are provided so as to (1) display the amount of remaining toner step-by-step and (2) control the amount of toner transported by the toner transport devices 48*a* through 48*d*.

As described, since the toner replenishing device 30 has a large volume with respect to the lateral direction, even in the case of storing a large amount of toner, such a problem that the toner aggregates due to the dead weight can be avoided.

Further, the remaining toner amount detecting sensors 50*a* and 50*b* are provided on the upper surface of the hopper cover 44 in a direction parallel to the toner transport direction so as to detect step-by-step the upper surface of the toner being transported in the lateral direction. This permits the displaying of the amount of remaining toner for respective toner containers. Therefore, compared with the conventional toner shortage message "REPLENISH TONER", the user can recognize the number of the toner containers to be supplied to the toner replenishing device 30. Accordingly, it is possible to know the exact time when the toner should be replenished, and to avoid overloading of toner.

Furthermore, even in the case where toner is not present in a vicinity of the toner supply opening 47, the two remaining toner amount detecting sensors 50*a* and 50*b* are able to detect the presence of the toner if the toner remains in regions other than the vicinity of the toner supply opening 47, thereby wasting no toner.

Still a further, the toner adhered to the detecting surfaces of the remaining toner amount detecting sensors 50*a* and 50*b* can be removed as the remaining toner amount detecting sensors 50*a* and 50*b* are oscillated by the sensor oscillation plate 52, thereby permitting to provide the toner adhesion preventing mechanism of the remaining toner amount detecting sensors 50*a* and 50*b* at a low cost.

Further yet, the toner transport means are divided into (1) the first transport devices 48*a* and 48*b* and (2) the second transport devices 48*c* and 48*d* which are driven respectively by the motor 54 and the motor 55. (1) the first transport devices 48*a* and 48*b* and (2) the second transport devices 48*c* and 48*d* are able to control the amount of toner to be transported according to the results of detection by the remaining toner amount detection sensors 50*a* and 50*b*, thereby permitting stable supply of toner.

Note that, in the present embodiment, remaining toner amount detection sensors 50*a* and 50*b* are provided in order to detect the amount of remaining toner; however, three or more remaining toner amount detection sensors may be provided so as to permit the displaying of the amount of remaining toner in more detail.

Also, in the present embodiment, the toner transport means are divided into two blocks of (1) the first transport devices 48*a* and 48*b* and (2) the second transport devices 48*c* and 48*d* so as to control the amount of toner to be transported; however, the transport means may be divided into three or more groups so as to permit more delicate control.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner replenishing device, for use in an electrophotographic apparatus for developing toner, which stores toner and supplies the stored toner to a development device, comprising;

a storage section for storing toner corresponding to an amount of several toner containers, each toner container containing a predetermined amount of toner, wherein said storage section has:

a toner replenishing opening for replenishing toner from outside said storage section, a toner supply opening for supplying toner to the development device, and a space provided, a dimension of an extent of the space being from the toner replenishing opening to the toner supply opening, the dimension of the extent of the space being substantially perpendicular to a direction of gravity;

toner transport means for transporting the toner stored in the storage section from the toner replenishing opening to the toner supply opening, and remaining toner amount detecting means for detecting that an amount of toner remaining in said toner replenishing device is an integral multiple of a volume of the toner container containing a predetermined amount of toner wherein the toner transport means is separately driven at respective predetermined positions so that the amount of toner to be transported by the toner transport means is an integral multiple of the volume of the toner containers, and said remaining toner amount detecting means is provided in respective vicinities of the toner transport means that is separately driven.

2. The toner replenishing device as set forth in claim 1, wherein the remaining toner amount detecting means are remaining toner amount detecting sensors, the remaining toner amount detecting sensors being provided on a single sensor oscillation plate.

3. The toner replenishing device as set forth in claim 2, wherein said sensor oscillation plate is oscillated by a cam member provided around a driving shaft of the toner transport means during driving of the toner transport means.

4. The toner replenishing device as set forth in claim 1, wherein said toner transport means includes (1) first toner transport means for transporting the toner in a vicinity of the toner replenishing opening to a vicinity of a central portion of the storage section and (2) second toner transport means for transporting the toner in the vicinity of the central portion of the storage section to a vicinity of the toner supply opening, the first toner transport means and the second toner transport means being driven respectively by first driving means and second driving means, and said remaining toner amount detecting means are a first remaining toner amount detecting sensor and a second remaining toner amount detecting sensor, the first remaining toner amount detecting sensor and the second remaining toner amount detecting sensor are provided respectively in vicinities of the first transport means and the second transport means, said toner replenishing device further comprising:

a driving linkage member for linking the first toner transport means and the second toner transport means only in a case where one of the first and second driving means fails to operate due to an accident so as to drive the first and second toner transport means by the driving means other than the driving means that fails to operate.

5. The toner replenishing device as set forth in claim 4, wherein driving power of the first and second driving means transmits to the first and second toner transport means through a driving transmission member, and in the case where the driving power is transmitted between the first toner transport means and the second toner transport means by the driving linkage member, said driving transmission member does not transmit the driving power to the failed driving means from the toner transport means.

6. The toner replenishing device as set forth in claim 5, wherein said driving transmission member includes a ratchet and a ratchet wheel, and the ratchet meshes with the ratchet wheel so as to transmit the driving power only when the driving power is transmitted from the first and second toner transport means to the first and second driving means respectively.

7. An electrophotographic apparatus, having a toner replenishing device, said toner replenishing device having a storage section for storing toner corresponding to an amount of several toner containers, each toner container containing a predetermined amount of toner, comprising:

the storage section has:

a toner replenishing opening for replenishing toner from outside the storage section;

a toner supply opening for supplying toner to a development device;

a space provided, a dimension of the extent of the space being from the toner replenishing opening to the toner supply opening, the dimension of the extent of the space being substantially perpendicular to a direction of gravity;

toner transport means for transporting the toner stored in the storage section from the toner replenishing opening to the toner supply opening, and wherein said toner replenishing device includes remaining toner amount detecting means for detecting that an amount of toner remaining in said toner replenishing device is an integral multiple of a volume of the toner container wherein the toner transport means is separately driven at respective predetermined positions so that the amount of toner to be transported by the toner transport means is an integral multiple of the volume of the toner container, and said remaining toner amount detecting means is provided in respective vicinities of the toner transport means that is separately driven.

8. The electrophotographic apparatus as set forth in claim 7, wherein said toner transport means includes (1) first toner transport means for transporting the toner in a vicinity of the toner replenishing opening to a vicinity of a central portion of the storage section and (2) second toner transport means for transporting the toner in the vicinity of the central portion of the storage section to a vicinity of the toner supply opening, the first toner transport means and the second toner transport means being driven respectively by first driving means and second driving means, and said remaining toner amount detecting means includes a first remaining toner amount detecting sensor and a second remaining toner amount detecting sensor, the first remaining toner amount detecting sensor and the second remaining toner amount detecting sensor are provided respectively in vicinities of the first transport means and the second transport means respectively, said electrophotographic apparatus further comprising:

control means for controlling the first and second driving means according to the results of detection by the first and second remaining toner amount detecting sensors.

9. The electrophotographic apparatus as set forth in claim 8, wherein the control means controls the first and second driving means so that the amount of toner transported by the first toner transport means is larger than the amount of toner transported by the second toner transport means, said first and second driving means being controlled when the first remaining toner amount detecting sensor detects a presence of toner and the second remaining toner amount detecting sensor detects a absence of toner.

10. The electrophotographic apparatus as set forth in claim 8, further comprising:

a lid member for freely opening and closing the toner replenishing opening; and a lid opening-closing detecting sensor for detecting opening and closing of the lid member, wherein the control means controls the first driving means and the second driving means according to a signal that the lid opening-closing detecting sensor has detected closing of the lid member so as to drive the first driving means and not to drive the second driving means, said first and second driving means being controlled when the first remaining toner amount detecting sensor detects the absence of toner and the second remaining toner amount detecting sensor detects the presence of toner.

11. The electrophotographic apparatus as set forth in claim 8, further comprising:

a lid member for freely opening and closing the toner replenishing opening; and a lid opening-closing detecting sensor for detecting opening and closing of the lid member, wherein the control means controls the first and second driving means according to a signal that the lid opening-closing detecting sensor has detected closing of the lid member so that the amount of toner transported by the first toner transport means is larger than the amount of toner transported by the second toner transport means, said first and second driving means being controlled when the first remaining toner amount detecting sensor detects the presence of toner and the second remaining toner amount detecting sensor detects the absence of toner.

12. The electrophotographic apparatus as set forth in claim 8, further comprising:

a lid member for freely opening and closing the toner replenishing opening; and a lid opening-closing detecting sensor for detecting opening and closing of the lid member, wherein the control means controls the first and second driving means according to a signal that the lid opening-closing detecting sensor has detected closing of the lid member so as to stop driving of the first and second toner transport means, said first and second driving means being controlled when both of the first and second remaining toner amount detecting sensors detect the presence of toner.

13. The electrophotographic apparatus as set forth in claim 7, further including, display means for displaying the amount of toner remaining in the storage section in a number form in response to a result of detection by the remaining toner detecting means.

* * * * *